US008691032B2

(12) United States Patent
Thomas et al.

(10) Patent No.: US 8,691,032 B2
(45) Date of Patent: Apr. 8, 2014

(54) MICROSTRUCTURAL OPTIMIZATION OF AUTOMOTIVE STRUCTURES

(75) Inventors: Dylan Thomas, Columbus, OH (US); Duane Trent Detwiler, Powell, OH (US)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 13/431,345

(22) Filed: Mar. 27, 2012

(65) Prior Publication Data

US 2012/0180910 A1 Jul. 19, 2012

Related U.S. Application Data

(63) Continuation of application No. 12/247,477, filed on Oct. 8, 2008.

(60) Provisional application No. 61/040,989, filed on Mar. 31, 2008.

(51) Int. Cl.
*C21D 8/00* (2006.01)

(52) U.S. Cl.
USPC ..... 148/643; 148/647

(58) Field of Classification Search
USPC ..... 148/653, 643, 647
See application file for complete search history.

(56) References Cited

U.S. PATENT DOCUMENTS

| | | | |
|---|---|---|---|
| 5,868,456 | A | 2/1999 | Kowalski et al. |
| 5,916,389 | A | 6/1999 | Lundstrom |
| 6,293,134 | B1 | 9/2001 | Johnson |
| 6,454,884 | B1 | 9/2002 | McNulty et al. |
| 6,793,743 | B2 | 9/2004 | McNulty et al. |
| 6,918,224 | B2 | 7/2005 | Tjoelker et al. |
| 7,059,657 | B2 | 6/2006 | Bodin et al. |
| 7,172,238 | B2 | 2/2007 | Bodin et al. |
| 2003/0025341 | A1 | 2/2003 | Kollaritsch et al. |
| 2004/0040636 | A1 | 3/2004 | Watanabe et al. |
| 2004/0149362 | A1 | 8/2004 | Kusinski et al. |
| 2005/0011870 | A1* | 1/2005 | Bernhardt et al. ..... 219/121.64 |
| 2006/0185774 | A1* | 8/2006 | Nishibata et al. ..... 148/653 |
| 2007/0006461 | A1 | 1/2007 | McCrink et al. |
| 2007/0102955 | A1 | 5/2007 | Bodin et al. |
| 2007/0235113 | A1 | 10/2007 | Knaup |
| 2007/0261769 | A1 | 11/2007 | Bodin |
| 2008/0289393 | A1 | 11/2008 | Lee |

FOREIGN PATENT DOCUMENTS

| | | |
|---|---|---|
| GB | 1490535 | 11/1977 |
| GB | 2313848 | 12/1997 |
| JP | 2006-346751 | 12/2006 |
| JP | 2006326620 | 12/2006 |
| JP | 2006326620 A * | 12/2006 |

OTHER PUBLICATIONS

Merklein, M. et al.; "Investigation of the thermo-mechanical properties of hot stamping steels"; Journal of Materials Processing Technology 177 (2006); pp. 452-455; Elsevier B.V.

(Continued)

*Primary Examiner* — Weiping Zhu
(74) *Attorney, Agent, or Firm* — Mark E. Duell; Rankin Hill & Clark LLP

(57) ABSTRACT

A process for hot stamping a steel component is described. The hot stamping process enables the formation of one or more regions of the component to exhibit specific physical properties different than other regions of the component. The various processes are particularly well suited for forming a variety of automobile structural members.

16 Claims, 6 Drawing Sheets

(56) References Cited

OTHER PUBLICATIONS

Altan, Taylan; "Hot-stamping boron-alloyed steels for automotive parts, Parts I, II, & III"; Stamping Journal; Dec. 12, 2006; Jan. 18, 2007; Feb. 13, 2007; www.thefabricator.coml; Rockford, Illinois.

Supplementary European Search Report of European Serial No. 09727831.1 dated Apr. 14, 2011.

Hein Philipp et al., "Status and Innovation Trends in Hot Stamping of USIBOR 1500 P", Steel Research International, Verlag Stahleisen GmbH, Dusseldorf, DE vol. 79, No. 2, Feb. 1, 2008, pp. 85-91.

Database WPI Week 200708, Thomas Scientific, London, GB; AN 2007-078693 and English Abstract of JP 2006 326620 dated Dec. 7, 2006.

Database WPI Week 200660, Thomas Scientific, London, GB; AN 2006-580200 and English Abstract of JP 2006 198666 dated Aug. 3, 2006.

International Search Report of PCT/US09/34994 dated Apr. 30, 2009.

* cited by examiner

MICROSTRUCTURAL OPTIMIZATION OF AUTOMOTIVE STRUCTURES

CROSS REFERENCE TO RELATED APPLICATIONS

This application claims priority upon U.S. provisional application Ser. No. 61/040,989 filed Mar. 31, 2008.

BACKGROUND OF THE INVENTION

The presently disclosed embodiments are directed to the field of automotive components, and particularly, controlling the microstructure of regions within such components by use of particular hot stamping processes.

It is well known in the art to selectively heat treat vehicle components to impart desired characteristics to certain portions or regions of the component. For example, it is known to selectively heat a side intrusion door beam. Select portions of the beam may be heat treated to modify the load characteristics of the beam.

It is also known to selectively cool or quench in order to harden regions of vehicle components such as bumpers. Such components can be formed to exhibit improved strength from selective austenitic-martensitic hardening. Bumpers can be formed by stamping a bumper blank from sheet steel, forming the desired shape, and then hardening select portions of the shape by heating and cooling.

High strength door beams have also been produced. Such door beams are subjected to heating and quenching operations to impart high strength characteristics. End flanges attached to the door beam are not affected by the operations, and so can be readily shaped and welded.

It is also known to cold form a vehicle component, such as an impact beam, followed by heating the component in select regions and then quenching, to strengthened portions of the component.

Although satisfactory in many regards, these prior strategies for forming vehicle components utilize multiple operations which typically require additional manufacturing time, floor space, and capital expenditures.

Hot stamping processes are also known. The terms "hot stamping," "press hardening," or "die hardening" as referenced in Europe, refer to a stamping operation in which forming and quenching operations are performed in a single step. An article was recently published regarding this technique, Merklein et al., "Investigation of the Thermo-mechanical Properties of Hot Stamping Steels," *Journal of Materials Processing Technology,* 177 (2006), 452-455. Additionally, a three part collection of articles appearing in the *Stamping Journal* from December, 2006 through February, 2007 described hot stamping in the production of automotive components. These articles described forming complex, crash-resistant parts such as bumpers and pillars with ultra high strength, minimum spring back, and reduced sheet thickness. Various hot stamping processes are also generally referenced in the patent literature.

As design of automotive components becomes increasingly sophisticated, it is frequently desirable to produce a steel component having different physical characteristics in different regions of the component. As far as is known, hot stamping processes have been directed to the entirety of a steel member. And so, if it were desired to produce an engineered steel component with different physical characteristics at different regions of the component, it was generally not feasible to use currently known hot stamping processes.

Accordingly, a need remains in the art for an improved strategy for forming vehicle components by a hot stamping process, and particularly, one in which different regions of the components can be produced so as to exhibit different physical characteristics in those regions. Furthermore, it would be desirable to provide one or more hot stamping operations that enable the formation of vehicle components having regions with selective strength characteristics.

SUMMARY OF THE INVENTION

The difficulties and drawbacks associated with previous systems and methods are overcome in the present methods and apparatus for forming steel components having regions with particular physical properties different than the remainder of the component.

In one aspect, the present invention provides a process for forming a steel component with a high strength martensite microstructure in only a portion of the component after stamping in a die, and without removal of the component from the die. The process comprises stamping a steel component in a die, the steel component having a temperature greater than about 850° C. and an austenite microstructure throughout the entire component. The process also comprises cooling a desired portion of the steel component while the component is in the die at a cooling rate of greater than about 27° C. per second, so that the microstructure of the steel component in the desired portion undergoing cooling is transformed into a martensite microstructure. A remainder portion of the steel component is cooled at a rate of less than about 27° C. per second. During the cooling operations, the die contacts the entire surface of the steel component. And, the process comprises, after formation of the martensite microstructure in the desired portion, removing the component from the die.

In another aspect, the present invention provides a process for forming a desired microstructure in a region of a steel component different than the microstructure in remaining regions of the component, after stamping in a die and without removal of the component from the die. The process comprises identifying a region of a steel sheet to exhibit a desired microstructure in a steel component formed from the sheet, the microstructure being different than a microstructure in remaining regions of the component. The process also comprises identifying an area in a die corresponding to the identified region of the steel sheet. The process further comprises stamping a heated steel sheet in the die to form the steel component. And, the process comprises cooling the area in the die so as to achieve the desired microstructure in the identified region of the steel component which is then different than the microstructure in the remaining regions of the steel component. The die preferably contacts the entire surface of the steel component.

In yet another aspect, the present invention provides a process for obtaining a martensite microstructure in a region of a steel component and which is different than the microstructure in remaining regions of the component, after stamping in a die and without removal of the component from the die. The process comprises providing a steel sheet to be subsequently formed into a steel component. The process also comprises identifying a region of a steel sheet to exhibit a martensite microstructure in a steel component formed from the sheet, the martensite microstructure being different than a microstructure in remaining regions of the component. The process also comprises identifying an area in a die corresponding to the identified region of the steel sheet. And the process comprises heating the steel sheet to a temperature of at least 900° C. Next, the process comprises stamping the steel sheet in the die to form the steel component. And then, the process comprises cooling the area in the die so that the identified region in the steel component cools at a rate greater than 27° C. per second so as to achieve the martensite microstructure in the identified region of the steel component and which is different than the microstructure in the remaining regions of the steel component. The die preferably contacts the entire surface of the steel component during cooling.

As will be realized, the invention is capable of other and different embodiments and its several details are capable of modifications in various respects, all without departing from the invention. Accordingly, the drawings and description are to be regarded as illustrative and not restrictive.

DETAILED DESCRIPTION OF THE EMBODIMENTS

Figure 1:
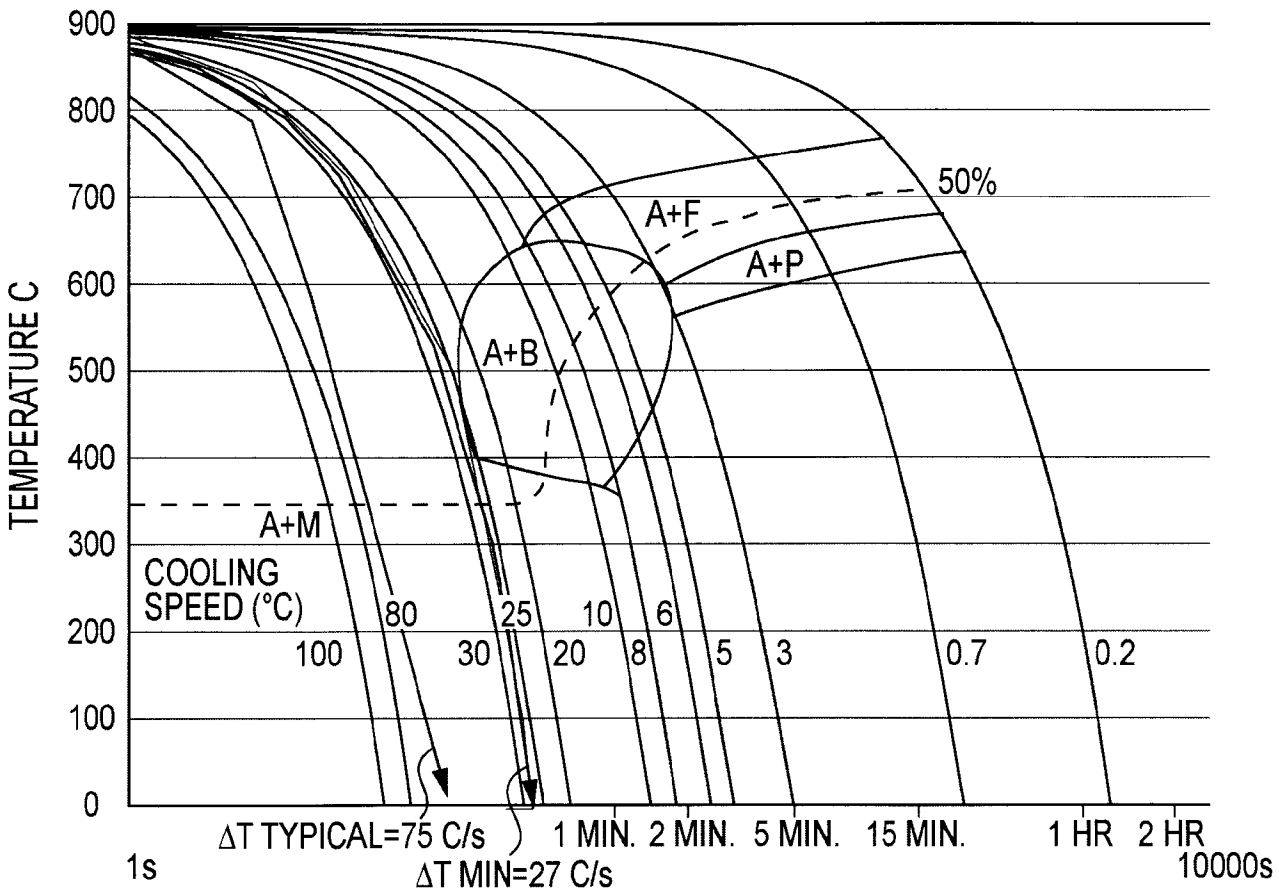
FIG. 1 is a graph illustrating formation of various microstructures in carbon steel depending upon the cooling rate.

If a sample of steel is heated in a furnace, at a high enough temperature, it will enter an austenite (A) phase, as depicted on its corresponding phase diagram. In the austenite phase, the iron atoms in the steel are arranged in a face centered cubic (FCC) structure.

When cooled from this phase, the steel will enter a phase where both ferrite (F) and austenite co-exist. The ferrite phase is a body centered cubic (BCC) structure and cannot dissolve as much of the interstitial carbon as the austenite phase. Therefore, carbon in the regions that are transforming to ferrite must diffuse to the still existing austenite regions, thereby enriching these regions. A phase diagram allows the prediction of how much ferrite and austenite exist, as well as the carbon composition of each, when the phases are in equilibrium at any temperature and composition.

For most steels, below 727° C., the remaining austenite phase (which is of the eutectoid composition, 0.77 weight percent (wt %) carbon) is unstable and transforms into ferrite and $Fe_3C$. This new arrangement of ferrite and carbide is known as pearlite (P) and the $Fe_3C$ phase is typically referred to as carbide or cementite. Again, the ferrite cannot dissolve the 0.77 wt. % carbon, so the carbon atoms in the ferrite regions must diffuse to the newly forming regions of carbide.

Because the formation of ferrite and pearlite depend on the diffusion of carbon, it is possible to cool austenite so quickly that the carbon atoms do not have sufficient mobility to arrange themselves into a thermodynamically preferred state. When steel is rapidly cooled by, for example, water quenching, the iron attempts to transform into its preferred BCC lattice structure (ferrite), but the carbon remains in solution and distorts the iron matrix into a body centered tetragonal (BCT) configuration. This BCT steel is known as martensite (M).

This transformation to martensite requires the Fe and C atoms to move very little, typically less than 1 angstrom, and is completed almost instantaneously. It does not rely on carbon diffusion. Martensite is a metastable phase. It is not the thermodynamically preferred condition, but there is not enough thermal energy to allow the carbon atoms to diffuse and allow the more stable ferrite and carbide arrangement to form. Therefore, the iron transforms to the BCC-like phase (BCT) and reduces the free energy from the FCC phase, but not as much as if it could form the preferred phase. Note that martensite can only be formed by the fast cooling of austenite. Quickly cooling ferrite, or other phases of steel, does not produce martensite.

If the cooling of the austenite is too fast for the carbon atoms to diffuse into a pearlite lamellae structure, but is still slow enough for the carbon atoms to diffuse short distances and form carbides, bainite (B) is formed. Instead of forming a layered structure, the carbide forms as small particles.

As previously noted, the martensite structure is metastable and will transform into a more thermodynamically stable structure under certain conditions. For example, by tempering martensite (heating it), a transformation occurs. The carbon atoms that are trapped in the iron lattice are then more mobile and diffuse to form carbide, as they do when pearlite or bainite are formed. This time however, they do not form the typical pearlite lamellar structure but instead, a spheroidal morphology. The size, structure, and quantity of the carbides are dependent on the temperature and on the time the transformation takes place. A higher temperature or a longer tempering time results in larger carbide spheres.

The physical properties of the resulting steel are very dependent on the type of microstructure that exists, e.g. pearlite, bainite, martensite, tempered martensite, etc. Martensite is a very hard microstructure. It has a fine grain size and the interstitial carbon atoms strain the Fe lattice. Both of these inhibit the dislocation movements that allow plastic deformation.

Tempered martensite is softer and more ductile. It is still relatively hard, though, since the carbide spheres are obstacles which inhibit dislocation movement. If the spheres are allowed to grow too large, the number of obstacles decreases and the material becomes softer. This condition is known as over-tempering.

Pearlite is relatively soft. Dislocations can move freely through the ferrite and therefore the material can easily plastically deform. The carbide phase is very strong but very brittle, while the ferrite phase is more ductile.

FIG. 1 is a representative graph illustrating the various phases of steel that are obtainable depending upon the rate of cooling adopted. The particular steel shown is a preferred embodiment steel commercially available under the designation USIBOR 1500P. Further explanation and reference to FIG. 1 is presented herein.

Hot stamping of steels is generally performed at high temperature, in which the steel is in an austenite phase, such that the steel has a FCC structure. In this process, the steel sheet is heated to a temperature in the austenite range. Typically, austenitized steel sheets are transferred from a furnace to a pressing machine, formed into a prescribed shape using dies maintained at room temperature, and simultaneously quenched. The press machine is retained at some relatively low temperature until the entire steel sheet is cooled sufficiently.

As previously described, the cooling rate of the steel must be high enough to have only austenite to martensite transformation. On the other hand, bainitic and/or ferritic transformation are, in most instances, not desired and so are prevented.

The main advantages of hot stamping are the excellent shape accuracy of the components and also the possibility of producing ultra high strength parts without any spring back. Due to transformation of austenite to martensite within the stamping operation, the spring back effect is avoided.

A hot stamping process typically comprises several different steps: austenization treatment or heating of a steel blank, transfer of the blank to a stamping die, hot pressing and cutting and piercing. Additional details of these steps are provided below.

In an austenization treatment, a steel blank is heated in a furnace to a temperature of at least about 850° C., and typically from about 900° C. to about 950° C. for several minutes. At such high temperatures, the steel is very ductile and is easily formed into complex shapes. The heating time generally depends on the thickness of the blanks. It is necessary to control the atmosphere of the furnace to limit decarburization.

In transferring the hot steel blank from the furnace to a die, it is desirable to perform this as quickly as possible to assure the required mechanical properties of the part. If temperatures of the blank fall below about 780° C., the microstructure will have then included some bainite and/or ferrite. As previously explained, depending upon the application of the final steel component, this may be undesirable.

Next, the hot blank is typically positioned within the die or tools by a robotic arm. Preferably, the die is at a temperature, such as ambient or room temperature. After pressing or stamping of the blank to form the steel component into its desired shape or geometry, the steel may remain in the die for a period of time if desired, to additionally cool the steel after pressing. Then, the steel component is removed from the tool at a temperature of around 80° C. to promote maintenance of final shape after the final air cooling. Typically, most hot stamping processes provide two or three stamps per minute.

Subsequent optional cutting and piercing operations can be performed by tools such as a conventional mechanical press. However, the high hardness of the steel after heat treatment likely necessitates the use of specific techniques and material for cutting dies.

Figure 4:
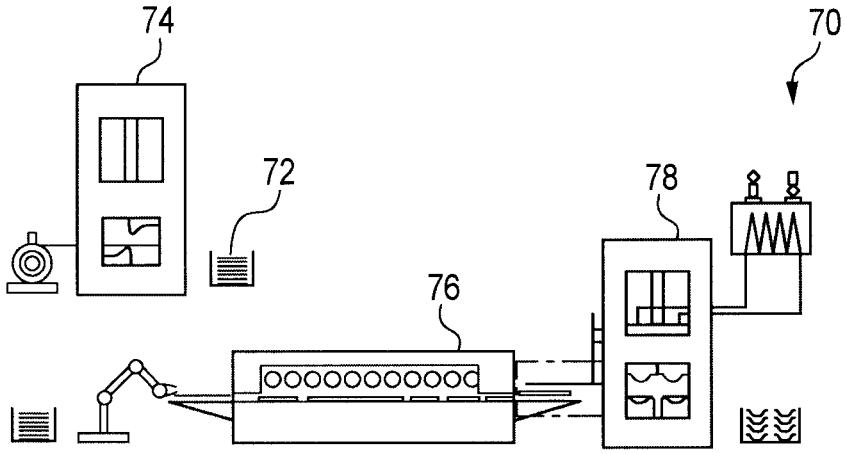
FIG. 4 is a schematic view of a hot stamping operation utilized in a preferred embodiment process in accordance with the present invention.
Figure 5:
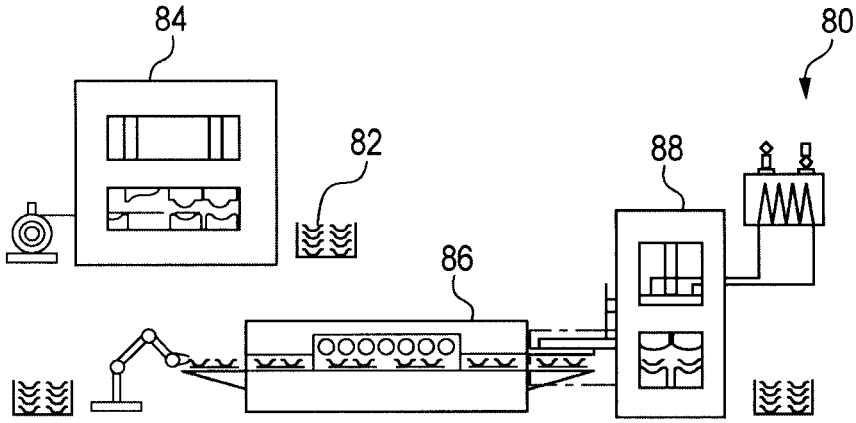
FIG. 5 is a schematic view of another hot stamping operation utilized in a preferred embodiment process in accordance with the present invention.

Several different strategies are known for hot stamping. The overall process, as previously described, is generally followed, but due to different economic and technical reasons, there are several differences in variant procedures. Direct and indirect hot stamping processes are two methods which, although differing from one another, offer certain advantages. Both direct and indirect hot stamping processes are illustrated in FIGS. 4 and 5. In direct hot stamping shown in FIG. 4 as process 70, a blank 72 formed from a cutter 74 is austenitized in a furnace 76 at a temperature of about 900° C. to 950° C. and then placed in a die 78 and formed at high speeds. Once the draw depth is reached the component is hardened by cooling. In contrast, during an indirect hot stamping process shown in FIG. 5 as process 80, the component 82 is first cold drawn to 90-95% of its final shape in a conventional die set 84. The preforms are then heated to austenization temperature in a furnace 86, formed to their final shape, and subsequently hardened in the die by cooling at unit 88. The strategy behind this method is to reduce abrasive wear on the die surfaces. For instance, when uncoated 22MnB5 steel is used, scales form on the surface. The relative movements between die and blank during a hot stamping process result in significant wear on the surface of die. The use of preformed parts reduces the relative movements and thus minimizes wear in the die.

In one preferred aspect of the present invention, the steel blank is heated, and preferably heated to its austenite temperature, directly in the die by resistance heating. In this process, heat loss of the blank before the forming operation is prevented by directly heating the sheet sets in the dies. The metal can be heated by electrical resistance upon application of an electrical current. Resistance heating is rapid enough to synchronize with a press and stamping operation, and has higher energy efficiency and requires smaller equipment than that associated with induction heating.

In accordance with the present invention, particular parameters and combinations of parameters associated with specific hot stamping processes have also been identified. Use of these preferred parameters in the particular hot stamping processes described herein, enable the formation of light weight, high strength steel components with particular preselected regions having one or more enhanced physical properties. These desired physical properties are achieved by selectively producing certain microstructures in the preselected regions. These aspects are all described as follows.

A wide array of steels can be used in the preferred embodiment processes. In the present invention, preferably, high strength boron-containing steel is used. An example of such a steel is available under the designation of USIBOR 1500 (including 1500P and other related grades), from Arcelor-Mital. This steel sheet is precoated with an AlSi coating, which exhibits advantageous corrosion-inhibiting properties in the course of subsequent heating. The precoating, i.e. the aluminum/silicon coating partially diffuses into the base steel material during heating to form a three phase laminated material Al/Si/Fe, which prevents scaling and decarbonization of the steel sheet during heating and thus makes certain subsequent operations unnecessary such as pickling and phosphatizing. The coating also permits conventional welding operations. An uncoated steel sheet for use in the preferred embodiment processes preferably exhibits the following composition (all percentages are percentages by weight unless indicated otherwise) set forth in Table 1. It will be appreciated that the remainder component of the steels noted in Table 1, is iron, Fe. The present invention includes the use of uncoated and coated steels.

TABLE 1

Composition of Steels for Preferred Embodiment Hot Stamping Processes

| Component | Typical | Preferred | Most Preferred |
|---|---|---|---|
| Carbon | 0.14-0.32% | 0.18-0.28% | 0.20-0.25% |
| Silicon | 0-0.50% | 0.10-0.40% | 0.15-0.35% |
| Manganese | 0.60-1.60% | 0.80-1.45% | 1.10-1.35% |
| Chromium | 0.04-0.45% | 0.08-0.40% | 0.10-0.35% |
| Titanium | 0-0.15% | 0.01-0.10% | 0.02-0.05% |
| Sulfur | 0-0.10% | 0-0.010% | 0-0.008% |
| Boron | 0-0.01% | 0.002-0.004% | 0.002% |
| Other | 0.001-2.00% | 0.001-1.00% | 0.001-0.50% |

Figure 6:
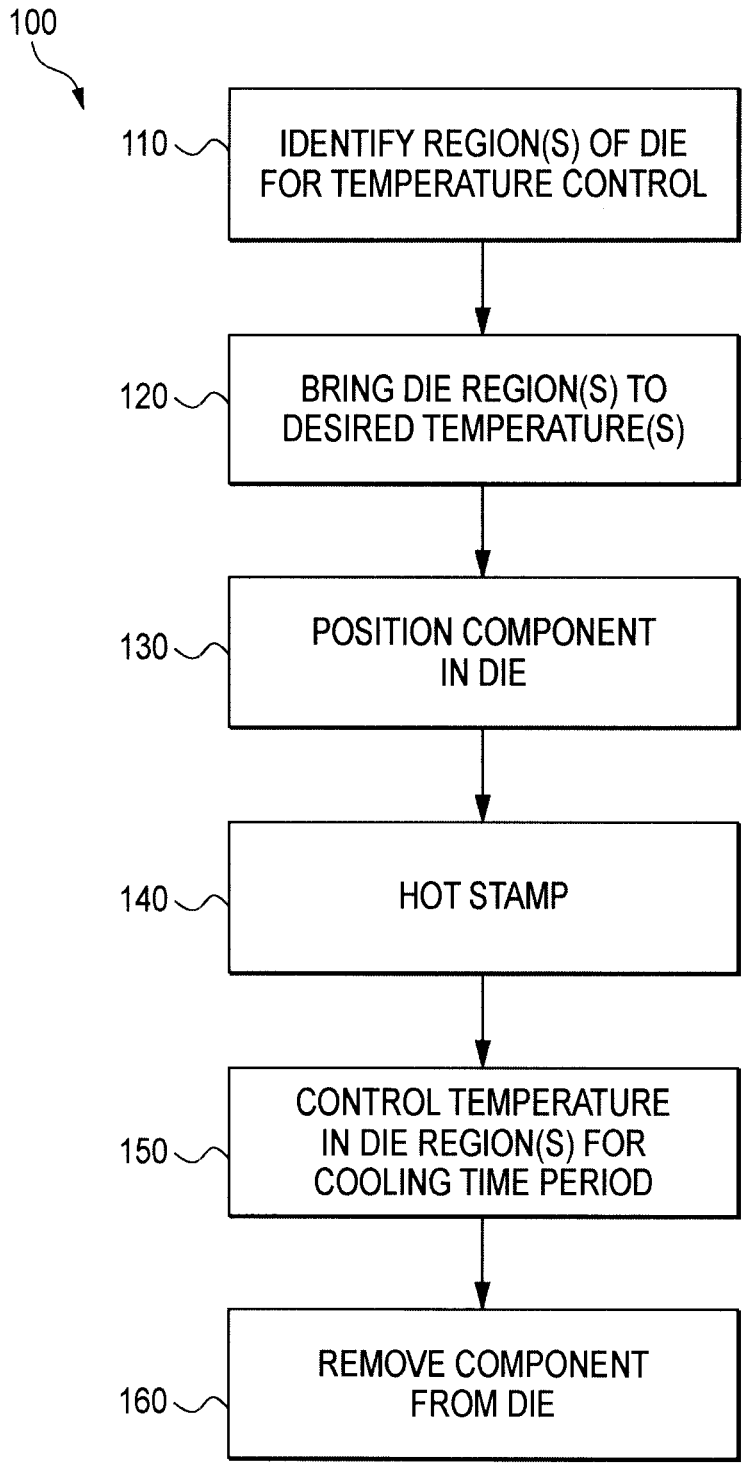
FIG. 6 is a flowchart illustrating a preferred embodiment process in accordance with the present invention.

FIG. 6 is a flowchart, illustrating a representative preferred embodiment process in accordance with the present invention. Specifically, the preferred embodiment process 100 comprises a plurality of steps as follows. In an initial operation, one or more region(s) of the die are identified for subsequent temperature control. The identified region(s) of the die correspond to the regions of the component with desired specifically tailored physical properties. The component is heated, subsequently transferred into the die, hot stamped, and subjected to a cooling operation as described in greater detail herein. For example, if a component is to have two specifically defined regions with certain physical properties resulting from the formation of martensite microstructures in those regions, but not in other areas of the component, then two areas on the die face corresponding to the two regions of the component are then identified. This identification operation is shown in the flowchart of FIG. 6 as operation 110.

After identification of the region(s) of the die(s) to be temperature controlled, those region(s) are then optionally appropriately heated or cooled to the desired temperatures(s). For example, in a liquid cooled die, one or more flow passages are opened or closed so that the heat transfer fluid, in a desired amount, may flow through the passages, and particularly, the passages associated with the region(s) of interest. If for example, it is desired to appropriately cool a selected region of the die since after hot stamping, the die will be heated from contact with the hot steel component; then one or more flow passages in thermal communication with that selected region of the die are opened. Heat transfer fluid, such as water or other conventional known fluids, are then directed into the selected passages in desired and known amounts so that the selected region(s) of the die are appropriately cooled. It is contemplated that one or more of the selected region(s) of the die could be heated. This operation of bringing the die, and in particular, selected region(s) of the die, to desired temperature(s) is designated as operation 120 in FIG. 6. It is to be understood that this step 120 is optional. That is, initiation of temperature controlling operations for selected region(s) of the die need not occur until after hot stamping.

Next, the heated steel component is positioned in the die. As previously described in conjunction with hot stamping processes, typically, such steel component is heated to a temperature of from about 900 to about 950° C. Heating the steel component to this temperature assures that the steel is in an austenite phase. This transfer operation is preferably performed by one or more robotic arms or robots. This operation is designated as operation 130 in FIG. 6. As previously noted, the present invention includes heating the steel directly in the die.

Next, the hot steel component is hot stamped. The hot stamping process is in accordance with the general description of such previously provided herein. This operation is designated as operation 140 in FIG. 6.

The region(s) of the die, previously identified in operation 110, are then temperature controlled so as to control the temperature of the steel in the component immediately adjacent those region(s). As will be appreciated, by controlling the temperature of the steel component in the selected region(s), the rate of cooling of the steel in those region(s) can be selectively controlled. And therefore, the microstructure of the steel in those region(s) can be selectively controlled. In order to induce the steel to transform from the austenite phase to a martensite phase, the rate of cooling of the steel must be greater than about 27° C. per second. It will be appreciated that the exact cooling rate to induce formation of a martensite microstructure from an austenite phase will depend upon the specific composition of the steel, hence use of the term "about." Given that the typical maximum cooling rate of the die is typically from about 50° C. per second to about 100° C. per second, then in order to obtain a martensite phase in selected region(s) of the steel component, the rate of cooling in the selected region(s) of the die is controlled so as to achieve a temperature in the steel component between these upper and lower temperature bounds. These details are graphically depicted in FIG. 1. This operation of controlling the temperature in the selected die region(s) is performed for a period of time until the steel has sufficiently cooled to retain its desired phase(s) and resulting microstructure(s). This operation is designated as operation 150 in FIG. 6.

Although the present invention methods include the use of any cooling rate, so long as it results in the desired phase in the region(s) of the steel component of interest, several particularly preferred cooling rates have been identified as follows. Generally, in order to form a martensite structure within a region of steel in an austenite phase, the steel within that region should be cooled at a cooling rate of from about 30° C./s to about 100° C./s, more preferably, from about 32° C./s to about 80° C./s, and more preferably, from about 35° C./s to about 70° C./s. It will be appreciated that the present invention includes cooling techniques that produce rates of cooling different than these exemplary ranges.

Next, the appropriately formed steel component, preferably sufficiently cooled, is then removed from the die. This operation is designated as operation 160 in FIG. 6.

Referring further to FIG. 6, operations 120 and 150 and particularly operation 150, can be performed by several alternative strategies. Since the maximum rate of cooling of the die (about 50° C./s to about 100° C./s) is typically significantly greater than the rate of cooling necessary to induce transformation into the martensite phase (27° C./s); it is contemplated that the die could be subjected to an excessive cooling operation and then portion(s) of the die, selectively heated so that certain areas are maintained at a desired temperature, or prevented from undergoing a cooling rate greater than that necessary to induce a phase change. Such heating could be accomplished by placement of one or more induction heating coils within the die or associated tooling. The specific rates of cooling could be controlled by choice of the induction coil size, voltage . . . etc. Another strategy for an excessively cooled die, is to open portions of the die after hot stamping and allow the hot steel component to be exposed to air (or other environment) instead of the relatively high thermal conducting surfaces of the die. The exposed portions of the steel component will then cool less rapidly (via convection with the air) than portions of the steel component in contact with the die, which are undergoing cooling (via conduction) as a result of passage of heat transfer fluid within cooling passages in the die. The present invention includes a wide array of techniques for achieving desired cooling rates within selected region(s) of the die and/or the steel component therein.

Figure 7:
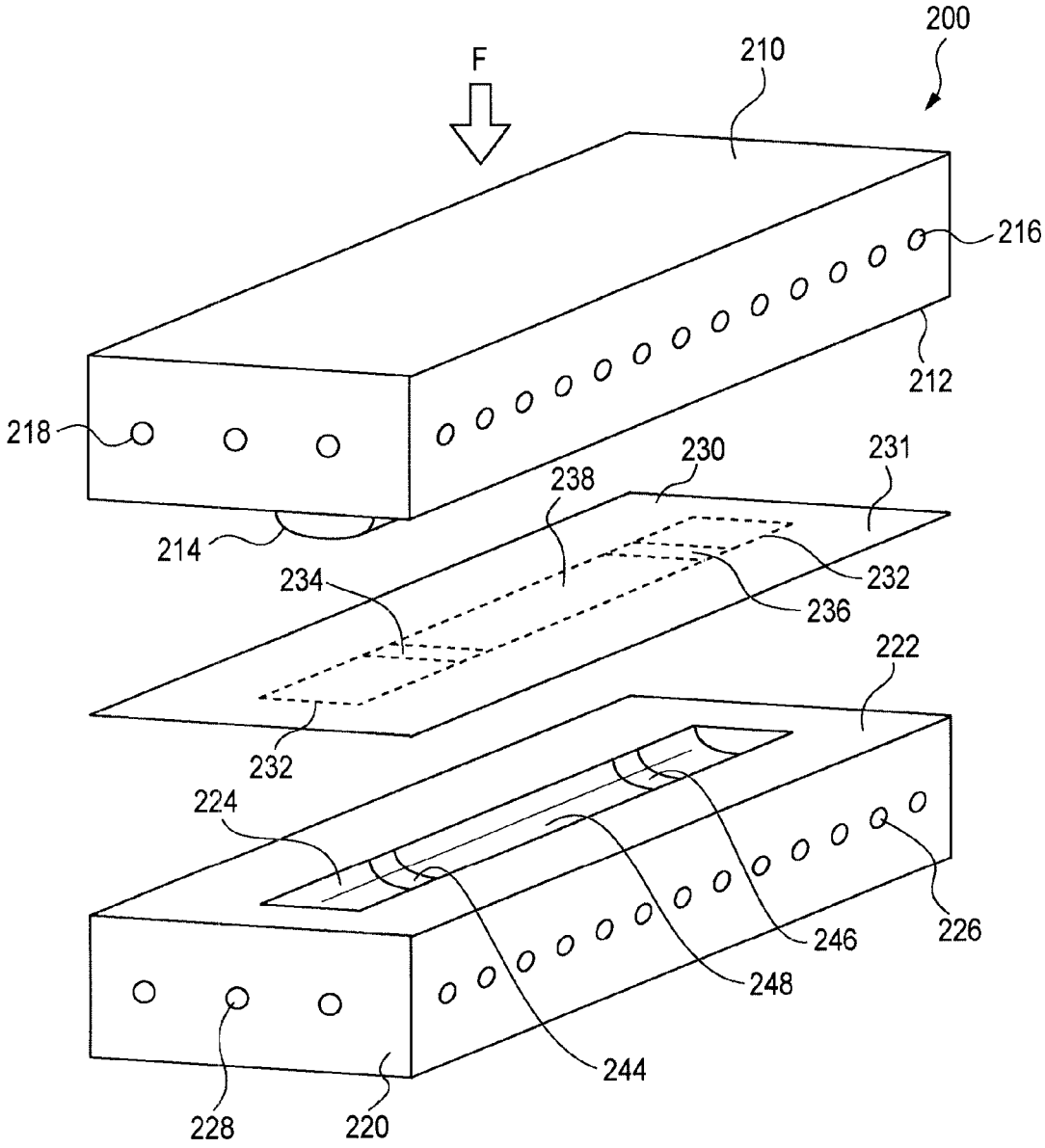
FIG. 7 is a schematic exploded illustration of a die assembly and steel sheet in performing a preferred embodiment process in accordance with the present invention.

FIG. 7 is a schematic exploded illustration of a die assembly 200 and steel sheet 230 in performing a preferred embodiment process in accordance with the present invention. Specifically, the die assembly comprises a first die 210 and a second die 220. It will be appreciated by those skilled in the art of stamping that these dies may be arranged and associated with one another in nearly any manner. Typically, the lower die 220 is stationary, and the upper die 210 is vertically positionable, and capable of movement in the direction of arrow F and transferring large amount of forces in that direction. The upper die 210 defines a downwardly directed die face 212, that in the representative assembly 200 depicted in FIG. 7, includes a projection 214 for assisting in the formation of a stamped component, described in greater detail below. The lower die 220 defines an upwardly facing die face 222 and a cavity or recessed region 224, also serving to assist in the formation of a stamped component. Each die preferably includes a plurality of cooling passages, for cooling medium to flow through. Specifically, the die 210 includes a first set of cooling passages 216 and a second set of cooling passages 218. And, the die 220 includes a first set of cooling passages 226 and a second set of cooling passages 228.

The steel sheet 230 is positioned between the dies, and specifically, between the die faces 212 and 222. In the illustrative example shown in FIG. 7, the steel sheet is to be hot stamped in the dies 210, 220. A steel component is to be formed as a result of the steel sheet being deformed to the shape defined between the projection 214 extending from the die 210 and the recession 224 defined in the second die 220. The outline of the steel component to be formed, is shown on the steel sheet 230 by the dashed line 232.

Continuing with the example depicted in FIG. 7, if it is desired to form two regions in the steel component having particular physical characteristics as a result of a certain microstructure formed in those regions, such as a first region defined by dashed line 234 and a second region defined by a dashed line 236, then in accordance with the present invention, the corresponding areas in the dies are identified. For the die 220, the area 244 within the recessed region 224 corresponds to the region 234 of the to-be-formed steel component. And, the area 246 within the recessed region 224 corresponds to the region 236 of the to-be-formed steel component. Corresponding areas in the die 210, and specifically, along the projection 214 (not shown) are preferably also identified.

Upon identification of the corresponding areas on the die faces or within or upon projections or recessions along the die faces, those area(s) are appropriately cooled or heated as desired to induce corresponding region(s) of the steel component to one or more desired phases, and thus microstructures. Heating or cooling of the areas on the die faces, and heating or cooling of the remainder portions of the die, such as region 248 in the recess 224, can be performed prior to, during, and preferably after hot stamping of the steel component.

In the preferred embodiment processes, it is most preferred that the entire area of the die or tool contact the corresponding area of the steel sheet or upon forming, the entire surface of the steel component. And, upon cooling, it is most preferred that the entire area of the die or tool continue to contact the corresponding area of the steel component. This practice is preferred over a practice in which certain areas of the die are intentionally spaced from the sheet or component so that the component undergoes different rates of cooling as a result of different heat transfer characteristics in those areas. Allowing or intentionally providing such spaced die-component interfaces increases part geometry deviation and reduces manufacturing consistency.

Figure 2:
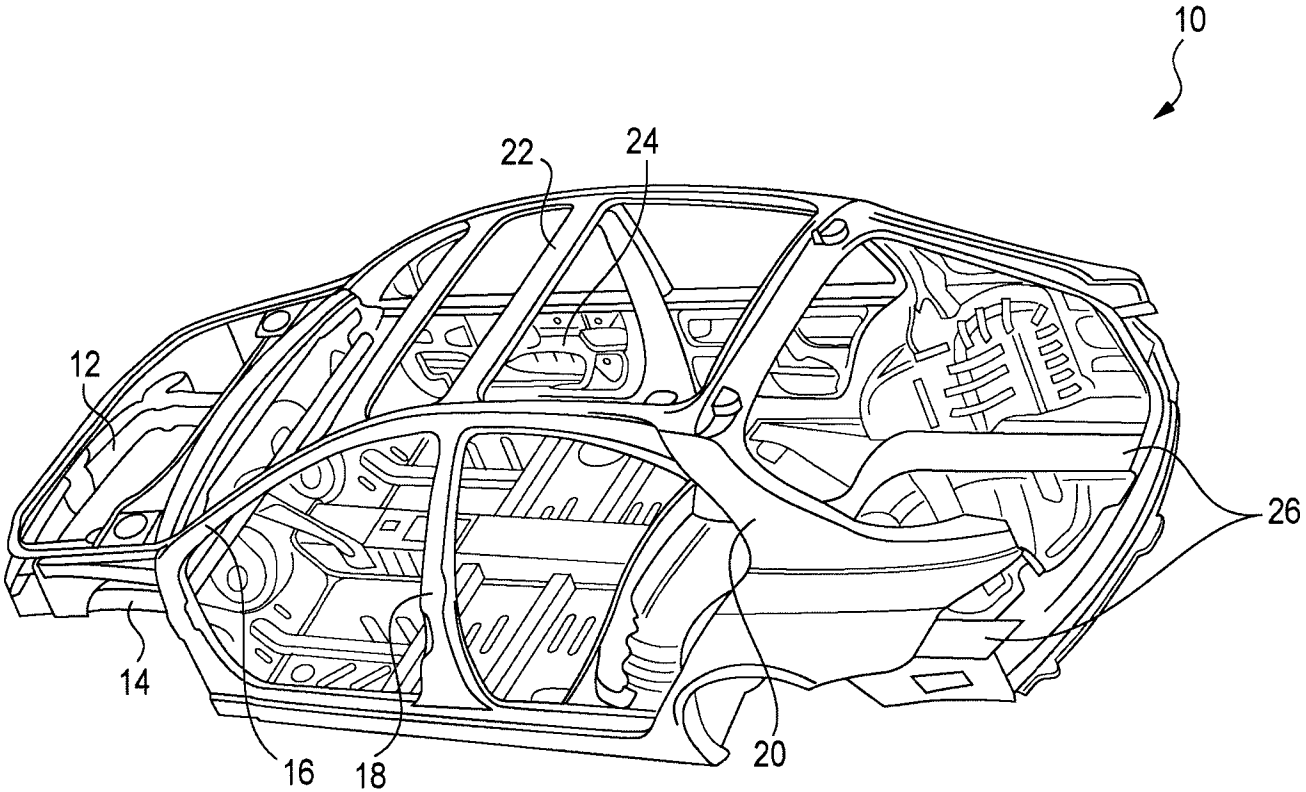
FIG. 2 is a schematic of a partially assembled automobile, illustrating representative panels and components formed in accordance with the preferred embodiment processes described herein.

The present invention provides for the formation of many different types of vehicle components. For example, various beams and reinforcement members including A-pillars, B-pillars, side rails, bumper members, front rails, rear rails, floor panels, hood, trunk, and door beams, and other body panels or members can be formed using the preferred embodiment processes described herein. Furthermore, various guards such as fuel tank guards and protective members can be formed using the preferred embodiment processes described herein. FIG. 2 illustrates a partially assembled vehicle, showing representative panels and components formed in accordance with the preferred processes described herein. Specifically, FIG. 2 illustrates a typical vehicle 10 comprising one or more panels, members or other components made using the preferred embodiment processes described herein. For example, a front bumper panel 12 supported by lateral front frame members 14 can be made using the preferred embodiment techniques. Similarly, A-pillar members 16, B-pillar members 18, and C-pillar members 20 can all be formed entirely or in part using the methods described herein. Upper roof members 22 or other body strengthening members can be formed. Also, inner panels such as door panels 24 can be formed using the preferred embodiment methods. Rear or other frame sections such as 26 can also be formed using the methods described herein.

Figure 3:
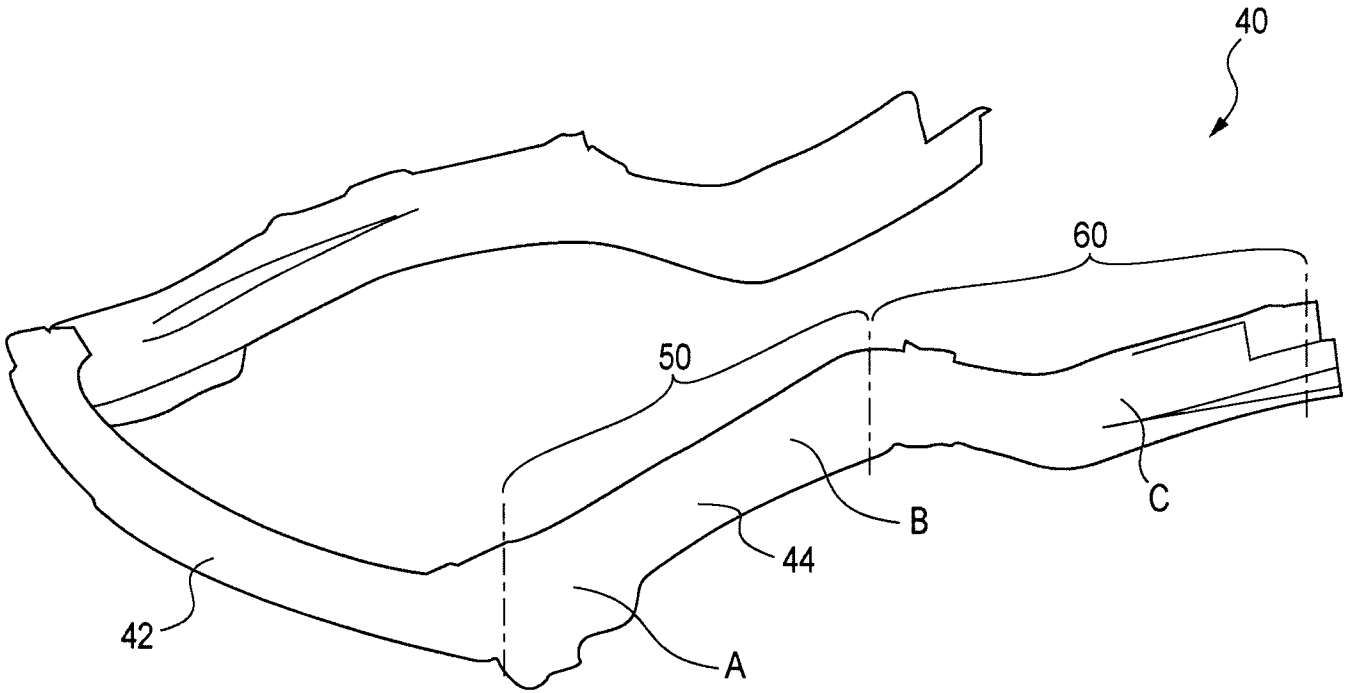
FIG. 3 is a partial view of an automobile frame section formed in accordance with the preferred embodiment processes described herein.

As noted, relatively heavy vehicle frames, members, and sections can be formed using the processes and principles described herein. It is also contemplated that optimization of structural components and assemblies could reduce part counts while increasing crash performance. Specifically, structural members could be tuned to crash deceleration pulses, by appropriate incorporation of regions of desired mechanical properties. FIG. 3 is a partial schematic view of a vehicle frame section having preselected regions formed to exhibit particular physical properties as a result of forming certain microstructures in those regions. Specifically, FIG. 3 shows a front portion of an automobile frame 40 including a bumper member 42 and a front lateral frame section 44 extending therefrom. Using the particular processes described herein, select microstructures can be formed at various regions of the frame 40. For instance, at location A, a ferrite/pearlite microstructure can be formed. At location B, a ferrite, pearlite, and martensite microstructure can be formed. And, at location C, a martensite microstructure can be formed. By inducing or otherwise causing these particular microstructures to form, regions of the frame can be made with specific characteristics. For example, by use of the noted microstructures at locations A and B, region 50 can be made to exhibit better energy absorbing properties. And, by formation of a martensite microstructure in region 60, a relatively strong region that is less likely to result in dash intrusion can be formed.

Generally, the preferred embodiment processes described herein can be applied to form nearly any type of steel component, in which it is desired to create particular regions within the part having certain physical characteristics different than other regions of the component. Typically, the thickness of steel components formed using the preferred embodiment hot stamping processes can be less than 1 mm up to a maximum thickness of 5 mm or more. Preferably, the thickness of such components is from about 1 mm to about 2 mm. It is also contemplated that the thickness of the steel component may vary at different regions of the component. For other steel components, such as frame sections, the thicknesses may be thicker, and in certain applications, much thicker.

Numerous advantages result from use of the various preferred processes described herein. For example, thinner and lighter components having regions of enhanced strength can be used in automobiles thereby reducing weight and increasing fuel economy. Improvements in occupant safety may also be realized by use of panels and members with regions of selected properties such as energy absorbing "crush" regions. Reduced manufacturing costs can also be realized as a result of improvements in formability and part accuracy.

Many other benefits will no doubt become apparent from future application and development of this technology.

All documents such as patents, published patent applications, or articles, referenced herein are incorporated by reference in their entirety.

As described hereinabove, the present invention solves many problems associated with previous methods and systems. However, it will be appreciated that various changes in the details, materials and arrangements of parts, which have been herein described and illustrated in order to explain the nature of the invention, may be made by those skilled in the art without departing from the principle and scope of the invention, as expressed in the appended claims.

What is claimed is:

1. A process for forming a martensite microstructure in a region of a steel component and which is different than the microstructure in remaining regions of the component, after stamping in a die and without removal of the component from the die, the process comprising:

cold drawing a steel sheet to a steel component;

identifying a region of the steel component to exhibit a martensite microstructure, the martensite microstructure being different than a microstructure in remaining regions of the steel component;

identifying an area in a die corresponding to the identified region of the steel component;

heating the steel component to a temperature of at least 900 ° C.;

stamping the heated steel component in the die;

cooling the area in the die so that the identified region in the steel component cools at a rate greater than 27 ° C. per second so as to achieve the martensite microstructure in the identified region of the steel component and which is different than the microstructure in the remaining regions of the steel component; and opening a portion of an area in the die corresponding to the remaining regions of the steel component, exposing a portion of the remaining regions of the steel component to air, and cooling the portion by the air at a cooling rate of less than 27 ° C. per second.

2. The process of claim 1, wherein the steel sheet is cold drawn to 90-95% of a final shape and the heated sheet component is stamped to the final shape.

3. The process of claim 1, wherein a portion of the remaining regions of the steel component has a ferrite and pearlite microstructure.

4. The process of claim 1, wherein a portion of the remaining regions of the steel component has a ferrite, pearlite, and martensite microstructure.

5. The process of claim 1, wherein one portion of the remaining regions of the steel component has a ferrite and pearlite microstructure and the other portion of the remaining regions of the steel component has a ferrite, pearlite, and martensite microstructure.

6. The process of claim 1, wherein the steel sheet has a composition including 0.14-0.32% carbon, 0-0.50% silicon, 0.60-1.60% manganese, 0.04-0.45% chromium, 0-0.15% titanium, 0-0.10% sulfur, 0-0.01% boron, and 0.001-2.00% of other agents.

7. The process of claim 1, wherein the steel sheet comprises an AlSi coating thereon, and the process further comprises forming a three phase laminated material Al/Si/Fe on the steel component during heating the steel component.

8. A process for forming a martensite microstructure in a region of a steel component and which is different than the microstructure in remaining regions of the component, after stamping in a die and without removal of the component from the die, the process comprising:

providing a steel sheet to be subsequently formed into a steel component;

identifying a region of the steel sheet to exhibit a martensite microstructure in a steel component formed from the sheet, the martensite microstructure being different than a microstructure in remaining regions of the steel component;

identifying an area in a die corresponding to the identified region of the steel sheet;

heating the steel sheet to a temperature of at least 900 ° C. in the die;

stamping the heated steel sheet in the die to form the steel component;

cooling the area in the die so that the identified region in the steel component cools at a rate greater than 27 ° C. per second so as to achieve the martensite microstructure in the identified region of the steel component and which is different than the microstructure in the remaining regions of the steel component; and opening a portion of an area in the die corresponding to the remaining regions of the steel component, exposing a portion of the remaining regions of the steel component to air, and cooling the portion by the air at a cooling rate of less than 27 ° C. per second.

9. The process of claim 8, wherein the steel sheet has a composition including 0.14-0.32% carbon, 0-0.50% silicon, 0.60-1.60% manganese, 0.04-0.45% chromium, 0-0.15% titanium, 0-0.10% sulfur, 0-0.01% boron, and 0.001-2.00% of other agents, the steel sheet further comprises, prior to stamping, an AlSi coating thereon, and the process further comprises forming a three phase laminated material Al/Si/Fe on the steel sheet during heating the steel sheet in the die.

10. The process of claim 8 further comprising:

identifying a second region of the steel sheet to exhibit a martensite microstructure;

identifying a second area in a die corresponding to the identified second region of the steel sheet; and cooling the second area in the die so that the identified second region in the steel component cools at a rate greater than 27 ° C. per second so as to achieve the martensite microstructure in the identified second region of the steel component.

11. The process of claim 8, wherein one portion of the remaining regions of the steel component has a ferrite and pearlite microstructure and the other portion of the remaining regions of the steel component has a ferrite, pearlite, and martensite microstructure.

12. A process for forming a martensite microstructure in a region of a steel component and which is different than the microstructure in remaining regions of the component, after stamping in a die and without removal of the component from the die, the process comprising:

providing a steel sheet to be subsequently formed into a steel component, the steel sheet comprising a composition including 0.14-0.32% carbon, 0-0.50% silicon, 0.60-1.60% manganese, 0.04-0.45% chromium, 0-0.15% titanium, 0-0.10% sulfur, 0-0.01% boron, and 0.001-2.00% of other agents, and further comprising an AlSi coating thereon;

cold drawing a steel sheet to a steel component;

identifying a region of the steel component to exhibit a martensite microstructure, the martensite microstructure being different than a microstructure in remaining regions of the steel component;

identifying an area in a die corresponding to the identified region of the steel component;

heating the steel component to a temperature of at least 900 ° C. in the die by resistance heating;

diffusing a portion of the AlSi coating into the steel component during heating to form a three phase laminated material Al/Si/Fe on the surfaces of the steel component;

stamping the heated steel component in the die;

cooling the area in the die so that the identified region in the steel component cools at a cooling rate of from 35 ° C. per second to 70° C. per second so as to achieve the martensite microstructure in the identified region of the steel component; opening a portion of an area in the die corresponding to the remaining regions of the steel component, exposing a portion of the remaining regions of the steel component to air, and cooling the portion by the air at a cooling rate of less than 27° C. per second to achieve the microstructure in the remaining regions which is different than the martensite microstructure.

13. The process of claim 12 further comprising:

identifying a second region of the steel component to exhibit a martensite microstructure;

identifying a second area in a die corresponding to the identified second region of the steel component; and cooling the second area in the die so that the identified second region in the steel component cools at a cooling rate of from 35° C. per second to 70° C. per second so as to achieve the martensite microstructure in the identified second region of the steel component.

14. The process of claim 12, wherein the steel sheet is cold drawn to 90-95% of a final shape and the heated sheet component is stamped to the final shape.

15. The process of claim 12, wherein a portion of an area in the die corresponding to the remaining regions of the steel component is heated to form the microstructure in the remaining regions which is different than the martensite microstructure.

16. The process of claim 12, wherein one portion of the remaining regions of the steel component has a ferrite and pearlite microstructure and the other portion of the remaining regions of the steel component has a ferrite, pearlite, and martensite microstructure.

* * * * *